United States Patent [19]

Suzuki et al.

[11] Patent Number: 4,937,411

[45] Date of Patent: Jun. 26, 1990

[54] COMBINATION MICROWAVE AND COMBUSTION APPARATUS FOR INCINERATING REFUSE

[75] Inventors: Jiro Suzuki, Nara; Atsushi Nisino, Neyagawa; Masato Hosaka, Osaka; Yoshitaka Kawasaki, Nabari, all of Japan

[73] Assignee: Matsushita Electric Industrial Co., Ltd., Kadoma, Japan

[21] Appl. No.: 313,961

[22] PCT Filed: Jun. 16, 1988

[86] PCT No.: PCT/JP88/00586

§ 371 Date: Apr. 14, 1989

§ 102(e) Date: Apr. 14, 1989

[87] PCT Pub. No.: WO88/10399

PCT Pub. Date: Dec. 29, 1988

[30] Foreign Application Priority Data

| | | | |
|---|---|---|---|
| Jun. 19, 1987 | [JP] | Japan | 62-153707 |
| Aug. 31, 1987 | [JP] | Japan | 62-216919 |
| Dec. 18, 1987 | [JP] | Japan | 62-322417 |

[51] Int. Cl.[5] ..... H05B 6/80; F23G 5/00

[52] U.S. Cl. ..... 219/10.55 R; 219/10.55 D; 110/250

[58] Field of Search ..... 219/10.55 R, 10.55 B, 219/10.55 D, 10.55 F; 110/250, 251, 252, 253, 235, 236, 346

[56] References Cited

U.S. PATENT DOCUMENTS

| | | | |
|---|---|---|---|
| 4,038,032 | 7/1977 | Brewer et al. | 110/212 |
| 4,592,291 | 6/1986 | Sullivan | 110/346 |
| 4,631,133 | 12/1986 | Axelrod | 110/250 |
| 4,718,358 | 1/1988 | Nomi et al. | 110/250 |

FOREIGN PATENT DOCUMENTS

| | | |
|---|---|---|
| 51-72765 | 6/1976 | Japan . |
| 57-184821 | 11/1982 | Japan . |
| 57-184832 | 11/1982 | Japan . |
| 58-133817 | 8/1983 | Japan . |
| 61-110948 | 7/1986 | Japan . |
| 61-253792 | 11/1986 | Japan . |
| 62-94717 | 5/1987 | Japan . |

*Primary Examiner*—Philip H. Leung

*Attorney, Agent, or Firm*—Cushman, Darby & Cushman

[57] ABSTRACT

The present invention relates to an electronic incinerating apparatus for incinerating organic matter such as garbage having a high rate of water content. This apparatus is composed of a primary combustion chamber (4) into which garbage to be burned is put and a secondary combustion chamber (18) in which decomposition gas of garbage (2) is burned; and the garbage (2) is decomposed or carbonized by microwave in the primary combustion chamber (4), and the decomposition gas is burned by an igniting apparatus in the secondary combustion chamber (18) where no microwave is irradiated. This constitution is characterized in that garbage is dried by microwave to become a good quality fuel, and is thereafter decomposed and burned perfectly, and therefore the exhaust gas is clean and the garbage can be burned perfectly to ashes at high temperatures, so that the treatment is extremely sanitary. The present invention relates to a constitution, control and materials for realizing an electronic incinerating apparatus, and the above-described operation can be carried out by these matters.

5 Claims, 1 Drawing Sheet

COMBINATION MICROWAVE AND COMBUSTION APPARATUS FOR INCINERATING REFUSE

TECHNICAL FIELD

The present invention relates to an electronic incinerating apparatus which is a combination of a microwave apparatus and a combustion apparatus and can cleanly incinerate garbage at very high temperatures, and this apparatus can solve the problem of uncleanliness, putrefaction and dirtiness of garbage, and is used particularly for treatment of garbage at a place such as a country house where sewage system is not complete or for treatment of dangerous filth produced by a hospital or biologic researchers.

BACKGROUND ART

In general, to treat garbage, so far the treating apparatuses have been used which crush garbage with a rotary blade called disposer and throw it away in sewage.

The disposer has a simple structure, while it discharges a large amount of solids into drainage, and therefore it is likely to cause stopping-up of sewage, and some countries prohibit the use of such an apparatus from the point of environmental pollution. Also, in hospitals, research institutes and the like, ordinary treatment of garbage is prohibited for sanitary reasons.

On the other hand, the combustion type treating apparatus is sanitary because it completely decomposes organic matters. In this method, fuel is burned by burners and garbage is treated by incinerating it by combustion heat of the fuel, and therefore this method has features of remarkably reducing the residual amount of treatment and causing disease germs and the like to perfectly perish, while it has major defects such that the structure is complicated, the apparatus becomes large-sized, smoke and bad smell are likely to be produced, and environmental pollution is caused. On the other hand, the method using electricity can employ an apparatus which is small-sized, easy to handle and excellent in controllability. However, the heater-heating system using resistance wires, although it is a system using electricity, is low in the incinerating temperature, and cannot carry out a satisfactory incineration. Accordingly, this system is difficult to burn garbage completely to ashes even if it can sterilize, and therefore it is not suitable for practical use. On the other hand, the method using microwave can incinerate garbage at high temperatures, and therefore it has a feature that the garbage treatment can be carried out perfectly. However, in the microwave incinerating system, the temperature of the generated flame becomes extraordinarily high, and an abnormal combustion or a damage of the apparatus is likely to be caused, and therefore it is difficult to be used also for a combustion apparatus. For this reason, the apparatuses using microwave have not propagated generally.

DISCLOSURE OF INVENTION

An object of the present invention is to provide a treating apparatus having a small size and a simple constitution which suppresses generation of smoke and smell in incinerating garbage, thereby causing no environmental pollution.

The above-mentioned object of the present invention can be achieved by the following constitution. This means that an apparatus of the present invention comprises a primary combustion chamber for storing matters to be burned, means for supplying air for combustion to the above-mentioned primary combustion chamber, a microwave generating source connected to the above-mentioned primary combustion chamber through a waveguide, a secondary combustion chamber installed on the above-mentioned primary combustion chamber, igniting means installed in the above-mentioned secondary combustion chamber, a microwave shield plate installed between the above-mentioned primary combustion chamber and the above-mentioned secondary combustion chamber, and a gas passage part open to the above-mentioned microwave shield plate.

The apparatus of the present invention is constituted as described above, and dries garbage by means of microwave to change it into fuel having a high quantity of heat, and thereafter decomposes organic matters by microwave to achieve a perfect combustion, and therefore the combustion temperature is high. Also, it has an excellent controllability of the quantity of combustion, can quickly increase or decrease the quantity of gas decomposition under control of microwave, can keep the ratio of air to fuel at combustion constant, and therefore can keep an optimum combustion temperature.

Furthermore, carbonized matter having lost gasified components causes a discharge spark by microwave, and this spark causes the carbonized garbage to burn. In addition, garbage contains components such as potassium and sodium which are easy to be put in the plasmic state, and therefore this flame is easy to receive microwave and become high-temperature plasma. The garbage is completely burned out by this action, and only a minute amount of incombustible ash remains.

Thus, according to the constitution of the present invention, the object of realizing an apparatus which, by perfectly burning garbage, eliminates an extraordinarily excessive combustion, bad smell or sanitary problems due to dirtiness of the apparatus can be achieved.

BEST MODE FOR CARRYING OUT THE INVENTION

Figure 1:
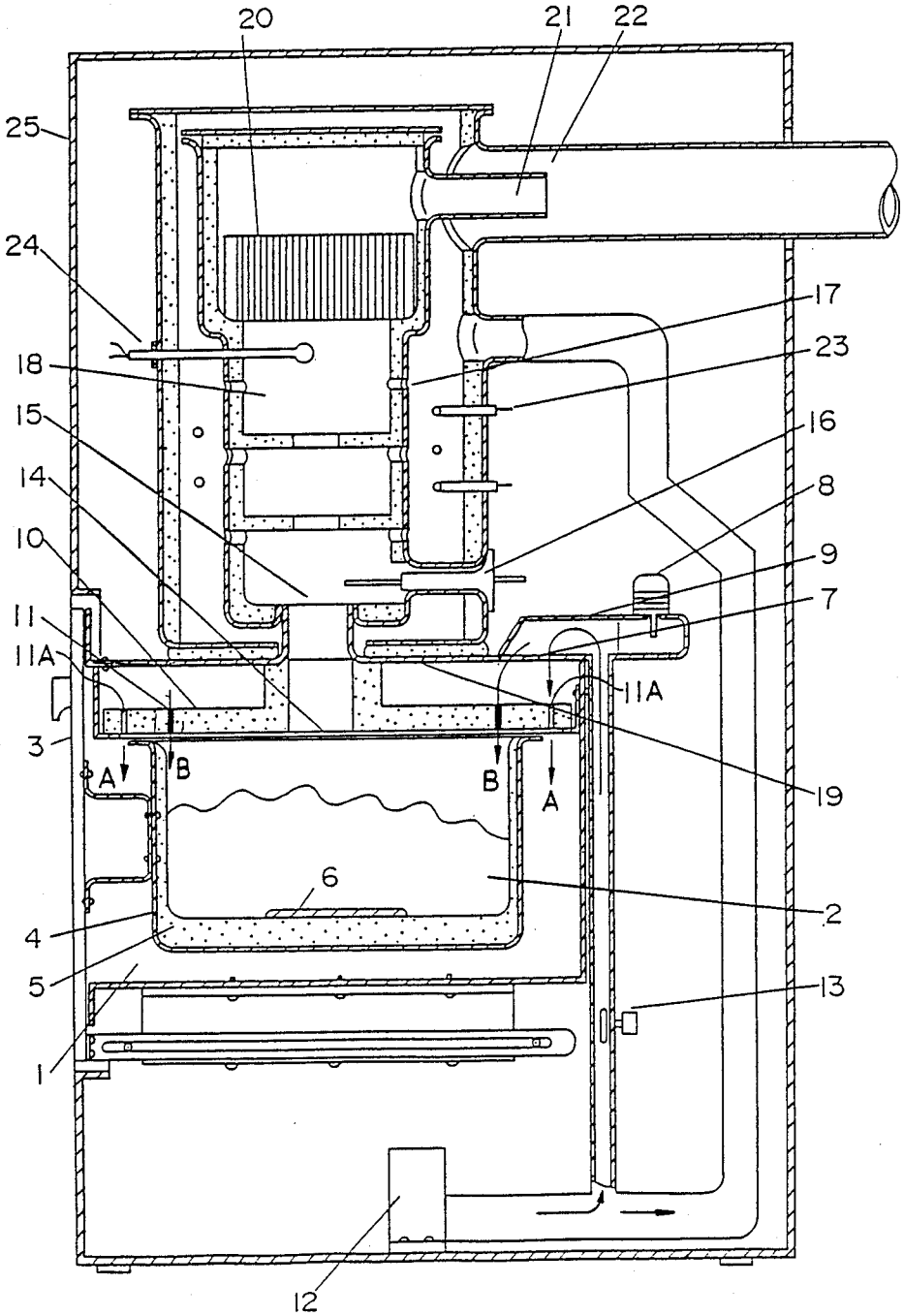
FIG. 1 is a cross-sectional view of one embodiment of an electronic incinerating apparatus in accordance with the present invention.

FIG. 1 is a cross-sectional view showing one embodiment of the present invention, and in FIG. 1, numeral 1 designates a storing chamber 2 designates garbage to be burned. At the front of the storing chamber 1, a door 3 is installed which can slide back and forth by means of rails. The garbage 2 is put in a pail-shaped primary combustion chamber 4 installed in the storing chamber 1. This primary combustion chamber 4 is fixed to the door 3. Also, a microwave absorber 6 such as silicon carbide plate or zirconia plate is installed at the bottom part of the primary combustion chamber 4 through an adiabatic material 5. Also, an opening 7 at the top of the storing chamber 1 communicates with an magnetron 8 through a waveguide 9.

Also, air holes 11A are installed in a top cover 10 installed at upper part of the storing chamber 1. Air for combustion is supplied to the primary combustion 4 through these airholes 11 an also a chink between the lower surface of the top cover 10 and the opening of the primary combustion chamber 4 by a blower 12 and a damper 13. A gas introducing hole 14 is installed at nearly the center of the top cover 10. Above from the storing chamber 1, a gas passage part 15 communicating with the gas introducing hole 14, an igniting heater 16, and a secondary combustion chamber 18 having combustion holes 17 are installed. The gas passage part 15 has a cylindrical shape of a diameter of one-fourth or less of the wavelength of microwave and a length of one-fourth or more of the wavelength thereof, and is constituted so that gas can pass therethrough, but microwave cannot path therethrough. Also, the secondary combustion chamber 18 is partitioned from the primary combustion chamber 4 by a ceiling of the storing chamber 19 made of microwave shield plate except for the gas passage part 15. Combustion air is sent to the combustion holes 17 of the secondary combustion chamber from the above-mentioned blower 12. Above the secondary combustion chamber 18, a catalyzer 20, an exhaust hole 21 and an exhaust gas diluting part 22 are disposed. Also, heater 23 are installed upstream air flow from the combustion holes 17 in the side wall of the secondary combustion chamber 18. Also, a combustion temperature detecting part 24 for detecting the combustion temperature is installed in the upper part of the secondary combustion chamber 18. Then, the apparatus thus constituted is enclosed with a case 25, and the side part of the apparatus is fixed to the case 25.

Hereinafter, description is made on operation of the apparatus of the present invention having the constitution as described above.

By pulling out the door 3 forth, the primary combustion chamber 4 can be taken out forward. The garbage 2 is put into the primary combustion chamber 4, and is set again in the storing chamber 1.

Next, drying is started by oscillation of the magnetron 8 and operation of the blower 12. Microwave of 2450 MHz from the waveguide 9 passes through the adiabatic top cover 10 made of microwave-permeable ceramic fibers, and generates a high electric field in a microwave-resonation space formed by the upper part of the storing chamber 1 and the primary combustion chamber 4. This microwave has a wavelength of 12 cm, and the diameter of the gas passage part 15 is set to 3 cm or less, and therefore this microwave does not go out of this gas passage part 15. Also the microwave reflects on a metal wall, and therefore almost all thereof is absorbed by moisture in the garbage 2. For this reason, the garbage 2 is dried quickly. Also at the same time, with the progress of drying of the garbage 2, the microwave absorber 6 begins to absorb the microwave and the temperature thereof becomes high, and the garbage 2 is dried also from the bottom part of the primary combustion chamber 4 by the heat of this microwave absorber 6. When moisture is removed, the microwave starts to heat the garbage, and decomposes the garbage 2 and generates gas. This gas passes through the gas passage part 15 and enters the secondary combustion chamber 18. The igniting heater 16 installed in the secondary combustion chamber 18 ignites the gas when the gas density in the secondary combustion chamber 18 increases gradually and the gas becomes inflammable.

Until the gas is ignited, moisture generated in the primary combustion chamber 4 is discharged through the secondary combustion chamber 18. At this time, if the secondary combustion chamber 18 contains moisture, a soot choking is caused in the gas passage part 15, or a poor ignition, a reduction in the combustion temperature or a generation of bad smell is caused due to a large latent heat of water. Particularly, if the ignition portion gets wet, the temperature thereof is reduced, and the relative density of the decomposition gas is reduced and the ignition becomes difficult. In the present invention, during the period of drying of this garbage 2, air is heated by the heater 23, and thereby the ignition part and the whole of the secondary combustion chamber 18 are heated so as not to get wet. At the same time, the heater 23 raise the temperature of the catalyzer 20 to the activating temperature thereof to prevent a generation of bad smell. Also, the flame in the secondary combustion chamber 18 is extinguished in the gas passage part 15 because the decomposition gas generated in the primary combustion chamber 4 blows out upward (secondary combustion chamber 18), and does not spread to the primary combustion chamber 4. To enhance this extinguishing effect, a wire net or a porous body can be installed in the gas passage part 15. When combustion is performed in the secondary combustion chamber 18, the garbage 2 which is fuel has been already dried, and therefore the catalyzer is not poisoned by moisture, the activity thereof is maintained and no bad smell is generated.

During the combustion of the decomposition gas in the secondary combustion chamber 18, the quantity of combustion is detected by the combustion temperature detecting part 24, and the microwave is controlled to suppress the quantity of combustion so as not to increase beyond the combustion capacity of this secondary combustion chamber 18.

At this time, air for combustion of 1–10% of that to the secondary combustion chamber 18 is sent to the primary combustion chamber 4. The amount of air smaller than this range is difficult to transfer the generated decomposition gas to the secondary combustion chamber 18, and bad smell sometimes escapes outside from the storing chamber 1. And, if the amount of air is larger than this range, the garbage 2 in the primary combustion chamber 4 is decomposed by the combustion heat of the garbage itself, and the control of the quantity of combustion by the control of the microwave cannot be performed.

The microwave is shielded by the ceiling of storing chamber 19 made of microwave shield plate so as not to enter the secondary combustion chamber 18 where high-temperature combustion is performed. The flame is ionized at high temperatures, and therefore if receiving the microwave, it would be put in a plasmic state and the temperature thereof becomes extremely high; but such a phenomenon does not take place in the secondary combustion chamber 18, and the constituent materials of the equipment are never melted. On the other hand, the primary combustion chamber is irradiated by the microwave, but when the garbage 2 is decomposing gasified components the amount of air is limited as described above, and therefore the amount of high-temperature flame is small, and an extremely large plasma is not generated. Even if a small-sized plasmic gas lump is generated in the primary combustion chamber, since the airflow from the chink and the airhole 11 move the plasmic gas lump toward the gas passage part 15, and microwave radiation cannot enter therein due to the selected diameter of the gas passage part 15, it will be extinguished after it enters the second combustion chamber 18. Accordingly, a breakage of the constituent material of the equipment does not occur.

Also, to prevent the gas passage part 15 from being choked with soot during combustion of the decomposition gas, the cylindrical tip is extended to the secondary combustion chamber 18, and the gas passage part 15 is kept at high temperatures by the heat of the secondary combustion chamber 18; and therefore the soot having adhered to the gas passage part 15 can be incinerated.

The apparatus of the present invention gasifies and burns components easy to be gasified by such a system; but with the progress of carbonization of the garbage 2, generation of gas is weakened.

This state is judged by the change in the combustion temperature, and by operating the damper 13, a large amount of air is sent to this carbonized matter to burn it to ashes. This change in the combustion temperature appears remarkably because the flame moves downward from the secondary combustion chamber 18 to the primary combustion chamber 4 when the garbage 2 loses gasification components. In and after this state, since the garbage 2 has already lost the decomposition gas, an excessive combustion is not performed even if a large amount of air is sent to the primary combustion chamber 4, and carbonizing combustion which is surface combustion starts, and the carbonized matter is heated in red.

In such a state, the microwave from the magnetron 8 generates discharge at the carbonized portion of the garbage 2, and the flame becomes a plasma state and accelerates the combustion of this carbon.

At the same time, the microwave absorber 6 also receives the microwave, and the temperature thereof becomes high and helps this combustion. Particularly, in the last of burning to ashes when the carbonized matter has been decreased, the combustion is continued by the heat of this microwave absorber 6. This microwave absorber 6 is installed on the bottom surface of the primary combustion chamber 4 with the adiabatic material or an air layer therebetween to prevent this heat from escaping outside the primary combustion chamber 4.

For the material of such a microwave absorber 6, silicon carbide, silicon nitride, and zirconia, particularly zirconia whereto yttria is added are preferably used which show high ion conductivities. These materials not only have high heat resistances and corrosion resistances, but also are hard to absorb microwave because of low temperatures at drying; and the garbage 2 is never scorched in the state of containing much moisture. On the other hand, they are easy to absorb microwave when burning to ashes, and therefore has a property of becoming high temperatures and maintain the combustion temperatures.

At this time of burning to ashes, the primary combustion chamber 4 becomes the highest temperature. Here, in the present invention, since a large amount of air B, A for the primary combustion is sent to the upper part of the top cover 10, it is prevented from becoming high temperatures.

The above is for the sake that, when the top cover 10 made of refractory ceramics such as alumina or silica becomes high temperatures, the ion conductivity of this material is increased, and penetration of the microwave is hindered, and the top cover 10 becomes high temperatures due to absorption of the microwave, resulting in a breakage.

In the apparatus of the present invention constituted and operated in such a manner, the reason why bad smell is hard to be generated is as follows.

The gas generated inside the primary combustion chamber 4 is almost a component not burnt yet, and is bad-smelling and extremely heavy.

The molecular weight of the generated gas is sometimes large by polymerization, and the gas is in a misty state, therefore being 5–12 times heavier than air.

Thus, the heavy gas can be transferred to the secondary chamber 18 by means of the light air for combustion without leaking outside. That is, the primary combustion chamber 4 is pressurized with the air B for combustion in the storing chamber 1 to prevent the gas from flowing out, and air B, A is fed from the chink formed between the lower surface and the opening of the primary combustion chamber 4, so as to envelop the gas in the first combustion chamber 4, and the gas flows out through the gas introducing hole 14 of the central upper part. In this constitution, the heavy gas can only stay below or ascend through the center of the primary combustion chamber 4 to go to the gas introducing hole 14, and therefore the gas is hard to escape from the chink between the upper part of the primary combustion chamber 4 and the top cover 10.

Further, the interior of the primary combustion chamber 4 becomes extremely high temperatures. Particularly, when the combustion heat at burning to ashes is added, the temperature thereof reaches nearly 1000° C. Radiation of this heat eliminates all of contamination of the upper part of the primary combustion chamber 4 and contamination of the top cover 10.

INDUSTRIAL APPLICABILITY

As described above, the apparatus of the present invention is made as a complex of the primary combustion chamber provided with a magnetron and the secondary combustion chamber consisting of an incinerator burning the gas coming from the primary combustion chamber, and therefore can incinerate garbage cleanly at super high temperatures, can solve the problem of uncleanliness, contamination and dirtiness of garbage, and thereby it having a great value in practical use.

We claim:

1. A microwave garbage incinerator comprising:

a primary combustion chamber having an opening in an upper part thereof;

a storing chamber for enclosing said primary combustion chamber;

a top cover made of a material passing microwave radiation for covering said opening of said primary combustion chamber, said top cover being mounted on an upper part of said storing chamber and having means defining a first opening at a central portion for passing gaseous substances therethrough while preventing passage of microwave radiation and at least a second opening for communicating to said storing chamber;

a microwave generating means for applying microwave radiation to said primary combustion chamber through said top cover;

blower means for directing air into said storing chamber through said second opening;

a secondary combustion chamber for burning gaseous substance having an aperture for communicating with said first opening of said primary combustion chamber; and a temperature sensor mounted in said secondary combustion chamber.

2. A microwave garbage incinerator as in claim 1, wherein a plate-like microwave absorber containing any one of zirconia, silicon carbide, silicon nitrate and yttria is mounted to a bottom wall of said primary combustion chamber by sandwiching an adiabatic member between said microwave absorber and the bottom wall of said primary combustion chamber.

3. A microwave garbage incinerator in accordance with claim 1, including means for controlling a strength of the microwave radiation in response to a temperature detected by said temperature sensor.

4. A microwave garbage incinerator in accordance with claim 1, wherein said means defining a first opening protrudes into said secondary combustion chamber.

5. A microwave garbage incinerator in accordance with claim 1, including means for changing an air quantity from said blower means in response to a temperature detected by said temperature sensor.

* * * * *